US008300836B2

(12) United States Patent
Pu et al.

(10) Patent No.: US 8,300,836 B2
(45) Date of Patent: Oct. 30, 2012

(54) DEVICE AND METHOD FOR AUTOMATICALLY TESTING AUDIO PLAYER DEVICE

(75) Inventors: Xiao-Man Pu, Shenzhen (CN); Jin-Quan Qiu, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 711 days.

(21) Appl. No.: 12/422,305

(22) Filed: Apr. 13, 2009

(65) Prior Publication Data

US 2010/0086142 A1 Apr. 8, 2010

(30) Foreign Application Priority Data

Oct. 6, 2008 (CN) ..... 2008 1 0304752

(51) Int. Cl.
*H04R 29/00* (2006.01)

(52) U.S. Cl. ..... 381/58; 700/94

(58) Field of Classification Search ..... 381/58, 381/60, 59; 700/94
See application file for complete search history.

(56) References Cited

U.S. PATENT DOCUMENTS 7,593,781 B1 * 9/2009 Rhea ..... 700/94
2006/0080104 A1 4/2006 Dang

FOREIGN PATENT DOCUMENTS

EP 1983520 A1 * 10/2008

* cited by examiner

*Primary Examiner* — Calvin Lee
*Assistant Examiner* — Scott Stowe
(74) *Attorney, Agent, or Firm* — Altis Law Group, Inc.

(57) ABSTRACT

A method for testing an audio player device is provided. The method includes: transcribing sound signals of each of the audio files which are supposed to be supported by the audio player device as a sound file; determining the ID code of each of the sound files; and determining whether the ID code of each of the sound files has been listed on a predetermined audio format table by comparing the ID code of each of the sound files with the ID codes listed on the audio format table, thus to determine which of audio formats listed on the audio format table is supported by the audio player device according to the relationships of the ID codes and the audio formats recorded by the audio format table. A test device applying the method to testing audio player devices is also provided.

11 Claims, 2 Drawing Sheets

DEVICE AND METHOD FOR AUTOMATICALLY TESTING AUDIO PLAYER DEVICE

BACKGROUND

1. Technical Field

The present disclosure relates to a device for automatically testing audio format compatibility of an audio player device and a method thereof.

2. Description of Related Art

In general, manufacturers will enable audio player devices to play audio files of different formats. Accordingly, a corresponding test is needed to check whether the audio player device is able to play audio files of all the audio formats that it is supposed to.

Typically, audio format testing of an audio player device requires an operator firstly to load audio files of the audio formats the audio player device is designed to be compatible with, and then open audio files one at a time to listen and judge whether the audio player device actually supports the audio format of the audio file. This process repeats till all the audio files are finished, which consumes a lot of time and manpower.

BRIEF DESCRIPTION OF THE DRAWINGS

The components of the drawings are not necessarily drawn to scale, the emphasis instead being placed upon clearly illustrating the principles of a device and a method for automatically testing an audio player device. Moreover, in the drawings, like reference numerals designate corresponding parts throughout several views.

DETAILED DESCRIPTION

Figure 1:
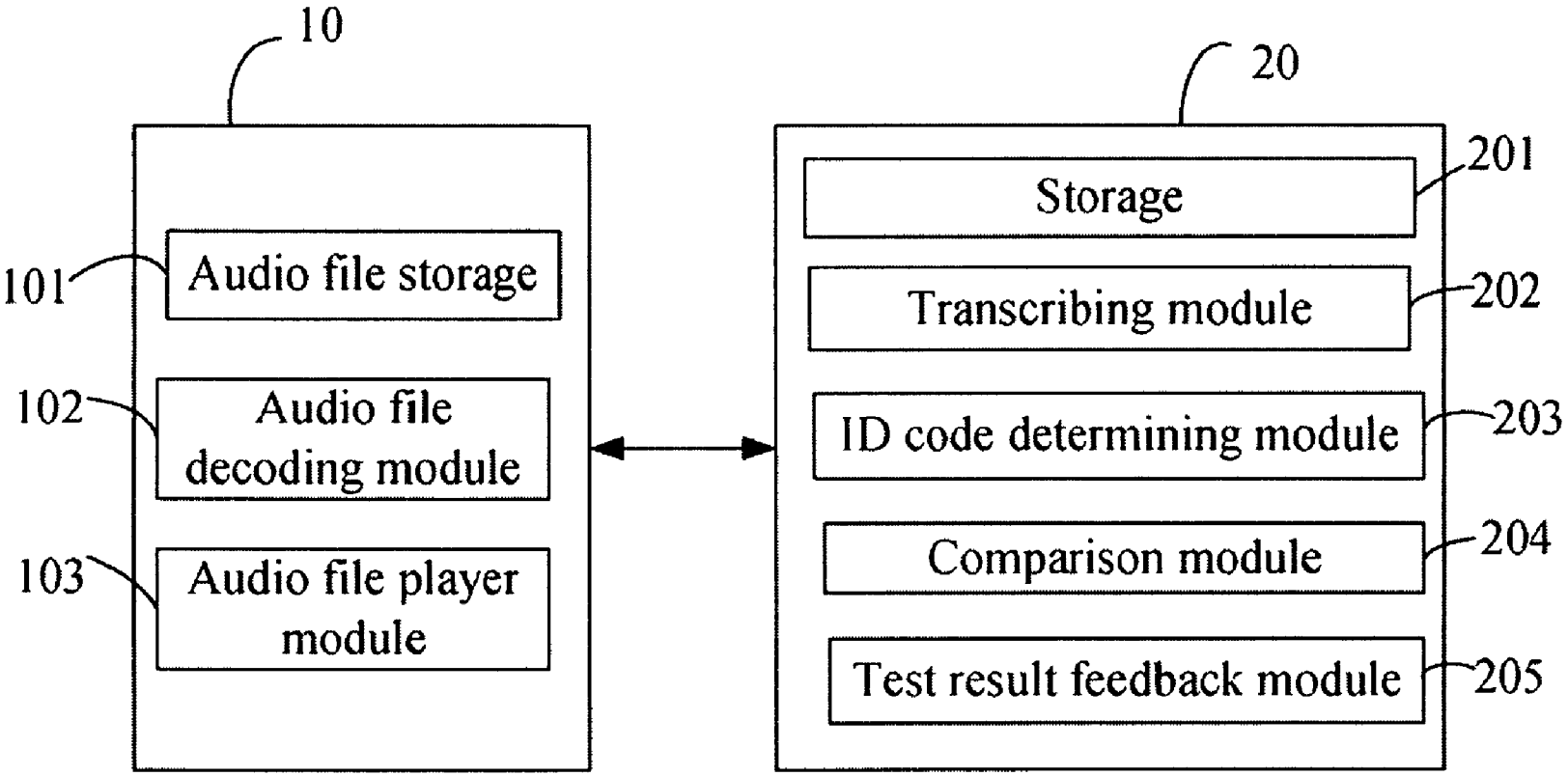
FIG. 1 is a hardware infrastructure diagram of a system for automatically testing an audio player device in accordance with an exemplary embodiment.

FIG. 1 is a hardware infrastructure diagram of a system for automatically testing an audio player device in accordance with an exemplary embodiment.

The system includes an audio player device 10 and a test device 20 interconnected with the audio player device 10, for testing what audio formats the audio player device 10 actually supports. The audio player device 10 can be an electronic apparatus, such as, but is not limited to, a MP3, a MP4, and so on. The audio player device 10 includes an audio file storage 101, an audio file decoding module 102, and an audio file player module 103.

The audio file storage 101 is configured for storing a plurality of special audio files with different audio formats which are supposed to be supported by the audio player device. Each of the audio files is assigned an identification (ID) code according to frequency information of the audio files. For example, if the frequency 1 Khz is coded as number "1", the frequency 1.5 Khz as number "2", the frequency 2 Khz as number "3", the frequency 2.5 Khz as number "4", and the frequency 3 Khz as number "5", an audio file whose frequency varies in a sequence of 1 Khz, 1.5 Khz, 1 Khz, 1.5 Khz, and 1 Khz in every section of the audio file is assigned an ID code "12121".

The audio file decoding module 102 is configured for decoding the audio files.

The audio file player module 103 is configured for reproducing the decoded audio files into sound signals in turn. The sound signals are transmitted to the test device 20.

The test device 20 includes a storage 201, a transcribing module 202, an ID code determining module 203, a comparison module 204, a test result feedback module 205.

The transcribing module 202 is configured for receiving and transcribing the sound signals from the audio player device 10. Sound signals reproduced from one audio file are saved as a sound file. In the exemplary embodiment, the lengths of all the audio files are the same and the reproduce of each of the audio files lasts the same amount of time. The transcribing module 202 begins to transcribe sound signals when the transcribing module 202 detects the audio player module begins to play an audio file. Upon expiration of the amount of time, the transcribing module 202 stops transcribing the sound signals and saves the sound signals as a sound file.

The storage 201 is configured for storing the sound files and an audio format table. The audio format table records relationships between the ID codes and audio formats which are supposed to be supported by the audio player device 10. An exemplary example of the audio format table is shown below.

Audio format table

| ID code | Audio format |
|---|---|
| 12121 | MP3 20 Kbps 11025 Hz Stereo |
| 12122 | WMA 20 Kbps 12000 Hz Stereo |
| 12123 | WMV 20 Kbps 8000 Hz Stereo |
| . . . | . . . |

The ID code determining module 203 is configured for determining an ID code of each of the sound files. In the exemplary embodiment, the ID code determining module 203 employs the Fourier Transform Algorithm or the Fast Fourier Transform Algorithm to process each of the sound files, thus to obtain frequency information of the sound files. The ID code determining module 203 then determines the ID code of each of the sound files according to their frequency information as described above.

The comparison module 204 is configured for determining whether the ID code of each of the sound files has been listed on the audio format table by comparing the ID code of each of the sound files with the ID codes listed on the audio format table, thus to determine which of the audio formats is supported by the audio player device 10. In detail, if the ID code of a sound file has been listed on the audio format table, the comparison module 204 determines the audio format corresponding to the ID code in the audio format table is supported by the audio player device.

The test result feedback module 205 is configured for producing a test result file and outputting the test result file to the user. The test result file records which of the audio formats are supported and/or which of the audio formats are not supported by the audio player device 10. An exemplary form of the test result file is a test result table of which an example is particularly shown below. In an alternative embodiment, the test result feedback module 205 is also configured for outputting a prompt signal, such as an audible alert if the comparison module 204 determines no audio format is supported by the audio player device 10.

Test result table

| ID code | Audio format | Supported or not |
|---|---|---|
| 12121 | MP3 20 Kbps 11025 Hz Stereo | Yes |
| 12122 | WMA 20 Kbps 12000 Hz Stereo | Yes |
| 12123 | WMV 20 Kbps 8000 Hz Stereo | No |
| ... | ... | ... |

Figure 2:
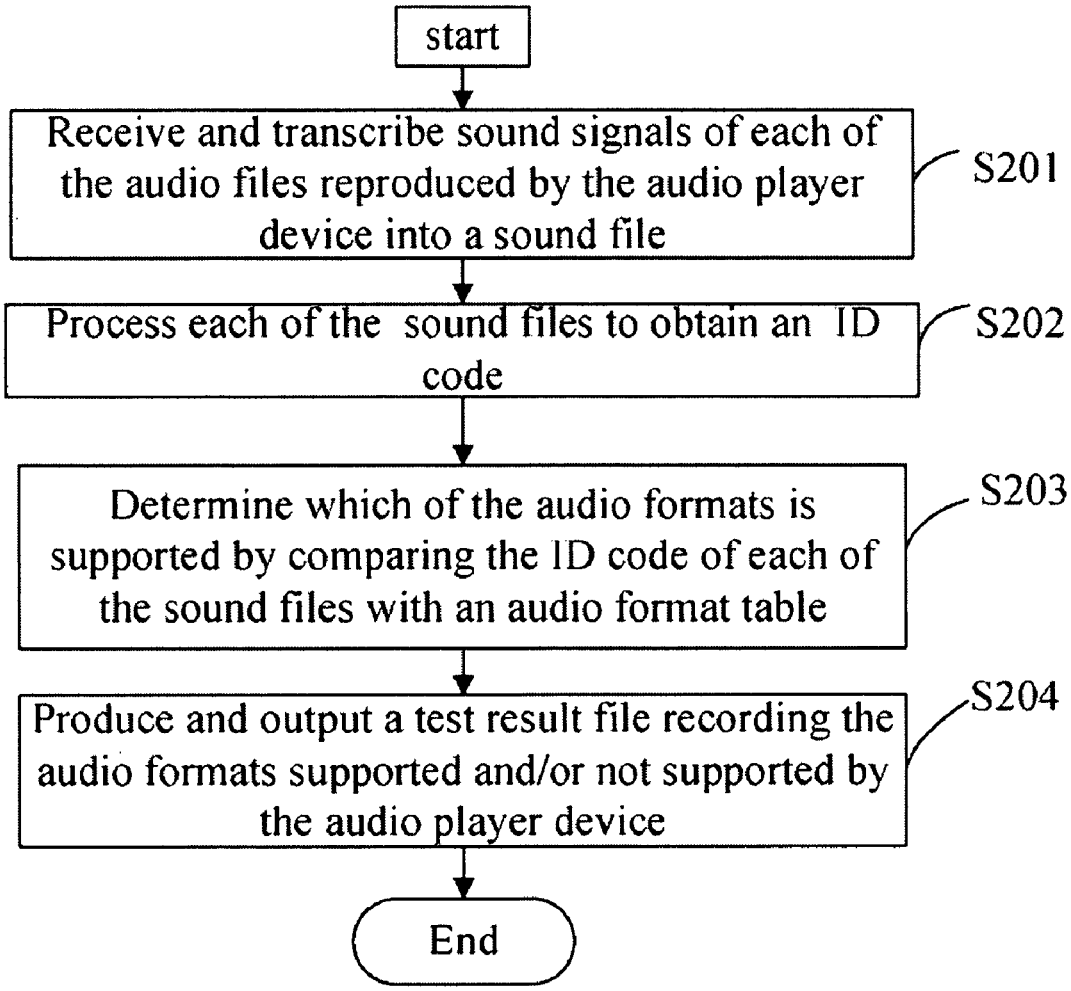
FIG. 2 is a flowchart of a method for automatically testing an audio player device implemented by the system of FIG. 1 in accordance with an exemplary embodiment.

FIG. 2 is a flowchart of a method for automatically testing the audio player device 10 implemented by the system in accordance with an exemplary embodiment.

In step S201, the transcribing module 202 receives and transcribes sound signals of each of the audio files reproduced by the audio player device 10, and saves the sound signals of each of the audio files as a sound file.

In step S202, the ID code determining module 203 employs the Fourier Transform Algorithm or the Fast Fourier Transform Algorithm to process each of the sound files to obtain frequency information of the sound files, and determines an ID code of each of the sound files according to their frequency information.

In step S203, the comparison module 204 determining whether the ID codes of each of the sound files has been listed on the audio format table by comparing the ID code of each of the sound files with the ID codes listed on the audio format table, thus to determine which of the audio formats is supported by the audio player device 10.

In step S204, the test result feedback module 205 produces a test result file recording which of the audio formats are supported and/or which of the audio formats are not supported by the audio player device, and outputs the test result file.

In an alternative embodiment, in step S203, if the comparison module 204 determines no audio format is supported by the audio player device 10, the test result feedback module 205 outputs a prompt signal, such as an audible alert, to notify users that no audio format is supported by the audio player device 10.

Although the present disclosure has been specifically described on the basis of preferred embodiments and method thereof, the disclosure is not to be construed as being limited thereto. Various changes or modifications may be made to the embodiments without departing from the scope and spirit of the invention.

What is claimed is:

1. A method for automatically testing an audio player device comprising:

transcribing sound signals of each of audio files reproduced by the audio player device into a sound file; wherein the audio files are of different audio formats which are compatible with the player device, and each audio file is assigned an ID code according to frequency information of the audio file;

determining an ID code of each sound file according to frequency information of the sound file; and determining whether the ID code of each sound file has been listed on a predetermined audio format table stored in a non-transitory storage by comparing the ID code of each sound file with all ID codes listed on the audio format table, thus to determine which audio format is supported by the audio player device, wherein the audio format table records relationships between each ID code and an audio format of an audio file assigned the ID code.

2. The method as described in claim 1, wherein the step of determining the ID code of each transcribed sound file comprises:

employing the Fourier Transform Algorithm or the Fast Fourier Transform Algorithm to process each transcribed sound file to obtain frequency information of the transcribed sound file, and determines the ID code of each transcribed sound file according to frequency information of the sound file.

3. The method as described in claim 2, further comprising:

producing and outputting a test result file recording the audio formats which are supported or which are not supported by the audio player device.

4. The method as described in claim 2, further comprising:

producing and outputting a test result file recording the audio formats which are supported as well as those which are not supported by the audio player device.

5. The method as described in claim 2, further comprising:

signaling that no audio format is supported by the audio player device upon the condition that the ID code of any of the transcribed sound file from the audio player device is not listed on the predetermined audio format table.

6. A test device for automatically testing an audio player device comprising:

a transcribing unit transcribing sound signals of each of audio files reproduced from the audio player device into a sound file, wherein the audio files are of different audio formats which are compatible with the player device, and each audio file is assigned an ID code according to frequency information of the audio file;

a non-transitory storage storing the transcribed sound files and an audio format table, wherein the audio format table records relationships between each ID code and an audio format of an audio file assigned the ID code;

an ID code determining unit determining an ID code of each sound file according to frequency information of the sound file; and a comparison unit determining whether the ID code of each sound file has been listed on the audio format table by comparing the ID code of each sound file with all ID codes listed on the audio format table, thus to determine which audio format is supported by the audio player device.

7. The test device as described in claim 6, wherein the lengths of all the audio files are the same, and the transcribing unit transcribes sound signals reproduced from each of the audio files according to the length of each of the audio files.

8. The test device as described in claim 7, wherein the ID code determining unit employs the Fourier Transform Algorithm or the Fast Fourier Transform Algorithm to process each of the transcribed sound files to obtain frequency information of the sound files, and determines the ID code of each transcribed sound file according to frequency information of the sound file.

9. The test device as described in claim 8, further comprising a test result feedback unit, wherein the test result feedback unit produces a test result file recording the audio formats which are supported or not supported by the audio player device, and further outputs the test result file to users.

10. The test device as described in claim 8, further comprising a test result feedback unit, wherein the test result feedback unit produces a test result file recording the audio formats which are supported as well as those which are not supported by the audio player device, and further outputs the test result file to users.

11. The test device as described in claim 8, further comprising a test result feedback unit, wherein the test result feedback unit outputs a prompt signal signaling that no audio format is supported by the audio player device if the comparison unit determines that the ID code of any of the transcribed sound file is not listed on the audio format table.

* * * * *